US005928831A

United States Patent [19]

Nakamura

[11] Patent Number: 5,928,831

[45] Date of Patent: Jul. 27, 1999

[54] METHOD FOR MANUFACTURING TONER FOR DEVELOPING ELECTROSTATIC LATENT IMAGE

[75] Inventor: Mitsutoshi Nakamura, Ibaraki, Japan

[73] Assignee: Minolta Co., Ltd., Osaka, Japan

[21] Appl. No.: 09/217,583

[22] Filed: Dec. 22, 1998

[30] Foreign Application Priority Data

Dec. 26, 1997 [JP] Japan ..... 9-359472

[51] Int. Cl.[6] ..... G03G 9/087

[52] U.S. Cl. ..... 430/137

[58] Field of Search ..... 430/137

[56] References Cited

U.S. PATENT DOCUMENTS 5,476,744 12/1995 Anno ..... 430/137
5,547,794 8/1996 Demizu et al. ..... 430/106
5,604,067 2/1997 Nagai et al. ..... 430/106.6
5,622,802 4/1997 Demizu et al. ..... 430/106

FOREIGN PATENT DOCUMENTS 61-091666 5/1986 Japan .
63-025664 2/1988 Japan .

*Primary Examiner*—Roland Martin
*Attorney, Agent, or Firm*—McDermott, Will & Emery

[57] ABSTRACT

A present invention relates to a method for producing a toner for developing electrostatic latent images comprising the steps of preparing a coloring resin solution containing a binder resin, a colorant and a non-aqueous organic solvent, forming an oil-in-water type emulsion by adding the coloring resin solution to an aqueous medium under reduced pressure of $5.0\times10^{4}$ to $1.0\times10^{-2}$ Pa and removing the non-aqueous organic solvent from the oil-in-water type emulsion.

20 Claims, No Drawings

METHOD FOR MANUFACTURING TONER FOR DEVELOPING ELECTROSTATIC LATENT IMAGE

RELATED APPLICATIONS

The present invention is based on Japanese Patent Application No. HEI 9-359,472, the content of which is incorporated by reference.

BACKGROUND OF THE INVENTION

1. Field of the Invention

The present invention relates to a method for manufacturing toner for developing electrostatic latent images. Specifically, the present invention relates to a method for manufacturing toner for developing electrostatic latent images having excellent image characteristics even with repeated copying when used to develop electrostatic latent images in electrostatic printing, electrostatic recording, and electrophotography.

2. Description of the Related Art

Emulsion dispersion is one type of method for manufacturing resin microparticles. This method produces resin microparticles by subjecting a resin solution produced by dissolving resin in a non-water soluble organic solvent to emulsion dispersion in an aqueous dispersion fluid under atmospheric pressure to form an oil-in-water (O/W) type emulsion, and heating this emulsion under continuous agitation to vaporize and remove the organic solvent. This emulsion dispersion method is capable of producing resin microparticles having an average particle size of approximately 1 to 10 $\mu$m via a relatively simple operation in a simplified process, thereby reducing costs while improving production efficiency compared to pulverization methods and suspension polymerization methods. Furthermore, more types of resins are usable compared to the suspension polymerization methods.

Consequently, this emulsion dispersion method has been proposed to disperse toner components such as colorant, charge controller, magnetic powder and the like in a resin fluid as an inexpensive and relatively simple method to produce toner for developing electrostatic images in accordance with user needs for color, high image quality, high speed developing and the like in printers and photocopiers of the electrophotographic type. For example, Japanese Laid-Open Patent Application Nos. SHO 61-91666 and SHO 63-25664 disclose methods for manufacturing toner for developing electrostatic images via the aforesaid emulsion dispersion method.

Toners for developing electrostatic images produced by the aforesaid emulsion dispersion method are disadvantageous in that image quality is affected due to some filming and fogging of the copy images from the start, and more marked fogging and filming after repeated copying.

On the one hand, this method produces resin microparticles by subjecting a resin solution produced by dissolving resin in a non-water soluble organic solvent, forming an oil-in-water (O/W) type emulsion produced by adding an aqueous dispersion fluid to the resin solution under atmospheric pressure, heating this emulsion under continuous agitation to vaporize and removing the organic solvent, disadvantages in that image quality (image stability) is affected, particularly when making repeated copies, similar to the aforesaid emulsion dispersion of resin solution in an aqueous dispersion fluid.

SUMMARY OF THE INVENTION

An object of the present invention is to provide a method of manufacturing a toner for developing electrostatic images having excellent image characteristics over a long term.

The present invention relates to a method for producing a toner for developing electrostatic latent images comprising the steps of preparing a coloring resin solution containing a binder resin, a colorant and a non-aqueous organic solvent, forming an oil-in-water type emulsion by adding the coloring resin solution to an aqueous medium under reduced pressure of $5.0\times10^{4}$ to $1.0\times10^{-2}$ Pa and removing the non-aqueous organic solvent from the oil-in-water type emulsion.

DESCRIPTION OF THE PREFERRED EMBODIMENTS

In the method of the present invention, it is possible to provide a simple method for manufacturing a toner for developing electrostatic images having excellent image characteristics over a long term by focusing on the process for forming the O/W type emulsion and accomplishing said process under reduced pressure. The toner particles produced by this method have markedly less interior cavities compared to toner particles produced by conventional emulsion dispersion methods and this toner is capable of supporting a sharp particle size distribution even with repeated copying, in contrast to conventional toner particles which readily collapse in the toner manufacturing process or with repeated copying due to their relatively large volume cavities, and further have broad particle size distributions due to the generation of large amounts of toner powder in connection with said collapse so as to adversely affect image characteristics due to the inability of the toner particles to maintain a uniform charge.

The present invention therefore is said to achieve the aforesaid final object by providing a method of manufacturing a toner for developing electrostatic images and which has few interior cavities.

The colored resin fluid used in the method of the present invention comprises at least a binder resin and a colorant dissolved and/or dispersed in a non-water soluble organic solvent. The binder resin is not particularly limited insofar as it can be dissolved in a non-water soluble organic solvent and is insoluble or nearly insoluble in water. Examples of usable binder resins include well known styrene resins, (meth)acrylic resin, styrene-(meth)acrylic copolymer resin, olefin resins, polyester resin, polyimide resin, carbonate resin, polyether resin, polyvinylacetate resin, polysulfone, epoxy resin, polyurethane resin, urea resin and the like used as binder resins in conventional toners either individually or in combinations of two or more types.

Such binder resins desirably have a glass transition temperature (Tg) of 50 to 70° C. and a number-average molecular weight (Mn) of 1,000 to 50,000, and more desirably 3,000 to 20,000, with a molecular weight distribution (Mw/Mn) expressing the ratio of Mn and the weight-average molecular weight (Mw) of 2 to 60. When the glass transition temperature Tg is less than 50° C., the obtained toner has reduced heat resistance, whereas when the glass transition temperature exceeds 70° C., toner fixing characteristics are reduced. When Mn is less than 1,000, the obtained toner is readily susceptible to high temperature offset, whereas when Mn exceeds 50,000, the toner is conversely readily susceptible to low temperature offset. When the ratio Mw/Mn is less than 2, there is concern of narrowing of the non-offset range of the obtained toner, whereas when the ratio Mw/Mn exceeds 60, low temperature offset readily occurs. When used as an oil application fixing toner, the ratio Mw/Mn is desirably 2 to 5, and when used as an oilless fixing toner, the ratio Mw/Mn is desirably 20 to 50.

After the binder resin is dissolved in a non-water soluble organic solvent, the binder resin desirably has a resin concentration of approximately 5 to 50 percent-by-weight, and may be increased more desirably to approximately 10 to 40 percent-by-weight. This resin concentration assures easy solidification of the fluid droplets on the microparticles in the process of removing the non-water soluble organic solvent from the liquid droplets by heating the O/W type emulsion.

Pigments of various colors, both organic and inorganic in type such as those listed below, may be used as colorant in the method of the present invention. These colorants may be added by creating a master batch with the binder resin or other resin for the purpose of improving dispersibility in the toner.

Examples of useful black pigments include carbon black, copper oxide, manganese dioxide, aniline black, activated carbon, non-magnetic ferrite, magnetic ferrite, magnetite and the like.

Examples of useful yellow pigments include chrome yellow, zinc yellow, cadmium yellow, yellow oxide, mineral fast yellow, nickel-titanium yellow, navel yellow, naphthol yellow S, hansa yellow G, hansa yellow 10G, benzidine yellow G, benzidine yellow GR, quinoline yellow lake, permanent yellow NCG, tartrazine lake and the like.

Examples of useful orange pigments include chrome orange, molybdenum orange, permanent orange GTR, pyrazolone orange, vulcan orange, indanthrene brilliant orange RK, benzidine orange G, indanthrene brilliant orange GK and the like.

Examples of useful red pigments include quinacridone, red oxide, cadmium red, red lead, mercury thiocyanate, cadmium, permanent red 4R, lithol red, pyrazolone red, Watchung red, calcium salts, lake red C, lake red D, brilliant carmine 6B, eosin lake, rhodamine lake B, alizarin lake, brilliant carmine 3B and the like.

Examples of useful purple pigments include manganese violet, fast violet B, methyl violet lake and the like.

Examples of useful blue pigments include Prussian blue, cobalt blue, alkali blue, alkali blue lake, Victoria blue, metallic phthalocyanine blue, nonmetallic phthalocyanine blue, partially chlorinated phthalocyanine blue, fast sky blue, indanthrene blue BC and the like.

Examples of useful green pigments include chrome green, chrome oxide, pigment green B, micalite green lake, final yellow-green G and the like.

Examples of useful white pigments include zinc white, titanium oxide, antimony white, zinc sulfide and the like.

Examples of useful extender pigments include baryte powder, barium carbonate, clay, silica, white carbon, talc, alumina white and the like.

The amount of added colorant is desirably 0.5 to 20 parts-by-weight, and more desirably 2 to 10 parts-by-weight, relative to 100 parts-by-weight of binder resin.

In the method of the present invention, a colored resin solution is produced by dissolving and/or dispersing the aforesaid binder resin and colorant in a non-water soluble organic solvent described later, and various other well known toner components, e.g., magnetic powder, anti-offset agent and the like, may be added to the colored resin solution as necessary.

Examples of magnetic powder include magnetite, gamma hematite, and various ferrite and the like. The amount of added magnetic powder is normally 10 to 500 parts-by-weight, and desirably 20 to 200 parts-by-weight, relative to 100 parts-by-weight of binder resin.

Examples of anti-offset agents usable to improve the fixing characteristics of the toner include various waxes, particularly low-molecular weight polypropylene, polyethylene, and oxidized polypropylene, polyethylene and like polyolefin waxes. The amount of added anti-offset agent is normally 0.1 to 30 parts-by-weight, and desirably 1 to 10 parts-by-weight, relative to 100 parts-by-weight of binder resin.

A charge controller may also be added when the binder resin and colorant alone provide the toner with inadequate charging characteristics. Various types of materials having physical properties to impart either a positive or negative charge via triboelectric charging may be used as charge controllers. Examples of useful positive charge controllers include nigrosine dyes such as nigrosine base EX (Orient Chemical Industries, Ltd.), quaternary ammonium salts such as quaternary ammonium salt P-51 (Orient Chemical Industries, Ltd.) and Copy Charge PX VP435 (Hoechst Japan), and imidazole compounds such as alkoxyamine, alkoxyamide, molybdate chelate pigment, and PLZ1001 (Shikoku Chemical Corp.) and the like; examples of usable negative charge controllers include metal complexes such as Bontron S-34 (Orient Chemical Industries, Ltd.), Bontron E-81 (Orient Chemical Industries, Ltd.), Bontron E-84 (Orient Chemical Industries, Ltd.), Spiron black (Hodogaya Chemical Industries, Ltd.) and the like, quaternary ammonium salts such as thioindigo pigments, Copy Charge NX VP434 (Hoechst Japan) and the like, and calix arene compounds such as Bontron E-89 (Orient Chemical Industries, Ltd.) and the like, boron compounds such as LR147 (Japan Carlit, Co., Ltd.) and the like, and fluorine compounds such as magnesium fluoride, carbon fluoride and the like, although the present invention is not limited to these materials. Metal complex negative charge controllers in addition to those mentioned above include materials having various structures including oxycarboxylic acid metal complexes, dicarboxylic acid metal complexes, amino acid metal complexes, diketone metal complexes, diamine metal complexes, benzene containing azo radicals-benzene derivative structural metal complexes, benzene containing azo radicals-naphthene derivative structural metal complexes and the like. The amount of added charge controller is normally 0.01 to 30 parts-by-weight, and desirably 0.1 to 10 parts-by-weight, relative to 100 parts-by-weight of binder resin.

The non-water soluble organic solvent used in the method of the present invention may be any organic solvent insofar as said organic solvent is insoluble or nearly insoluble in water, and can dissolve the resins of the binder resin and the master batch, e.g., toluene, xylene, benzene, carbon tetrachloride, methylene chloride, 1,2-dichloroethane, 1,1,2-trichloroethane, trichloroethylene, chloroform, monochlorobenzene, dichloroethylidene, methylacetate, ethylacetate, methylethylketone, methylisobutylketone and the like used individually or in combinations of two or more types, and wherein the most desirable materials are normally aromatic solvents such as toluene, ethylene and the like, and halogenated hydrocarbons such as methylene chloride, 1,2-dichloroethane, chloroform, carbon tetrachloride and the like.

The colored resin solution used in the method of the present invention comprises magnetic powder, anti-offset agent, charge controller and the like as necessary added to the non-water soluble organic solvent in addition to the aforesaid toner components, i.e., binder resin and colorant, so as to dissolve the materials dissolvable in the solvent by means of general mixing device such as, for example, a ball mill, sand grinder, or ultrasonic homogenizer and the like, until the insoluble components achieve uniform dispersion.

In the method of the present invention, the thus obtained colored resin solution is used together with the aqueous dispersion fluid to form an O/W type emulsion under reduced pressure. Forming of this emulsion under reduced pressure is believed to markedly reduce the cavities present within the obtained toner particles. Formation of this emulsion is accomplished by emulsion dispersion of the colored resin solution within the aqueous dispersion fluid under reduced pressure to form the O/W type emulsion, or adding the aqueous dispersion fluid to the colored resin solution under reduced pressure, and forming the O/W type emulsion by phase inversion emulsification.

When the O/W type emulsion is formed by emulsion dispersion of the colored resin solution in the aqueous dispersion fluid under reduced pressure (hereinafter referred to simply as "non-phase inversion"), specifically, the colored resin solution is added to the aqueous dispersion fluid, and mixed under reduced pressure using a general mixing device modified to mix materials in a vacuum such as a homogenizing mixer or the like, so as to adequately mix the materials to achieve emulsion dispersion. The mixing time is desirably 10 min or more. When the mixing time is too short, a sharp particle size distribution cannot be obtained. The reduced pressure is desirably $5.0\times10^4$ to $1.0\times10^{-2}$ Pa, more desirably $3.0\times10^4$ to $1.0\times10^{-1}$ Pa, and still more desirably $1.4\times10^4$ to 1.0 Pa. When the reduced pressure exceeds $5.0\times10^4$ Pa, sufficient effectiveness cannot be obtained from the reduced pressure, and when the reduced pressure is less than $1.0\times10^{-2}$ Pa, bubbles readily occur which tend to increase the cavities in the interior of the toner.

When the O/W type emulsion is formed by adding the aqueous dispersion fluid to the colored resin solution under reduced pressure to achieve phase inversion emulsification (hereinafter referred to simply as "phase inversion emulsification"), specifically, the colored resin solution is mixed continuously using, for example, a general mixing device such as a homogenizing mixer modified for mixing under reduced pressure, and adding the aqueous dispersion fluid to said solution under reduced pressure as said mixing continues, and stopping the addition when phase inversion is attained while thoroughly mixing the system to achieve emulsion dispersion. The mixing time is desirably 10 min or longer as in non-phase inversion emulsification. As in non-phase inversion emulsification, the reduced pressure is desirably $5.0\times10^4$ to $1.0\times10^{-2}$ Pa, more desirably $3.0\times10^4$ to $1.0\times10^{-1}$ Pa, and still more desirably $1.4\times10^4$ to 1.0 Pa. In the case of phase inversion emulsification, the aqueous dispersion fluid may be added in a vacuum established from the beginning to achieve phase emulsification, or the aqueous dispersion fluid may be added at normal pressure before the phase inversion state, or the aqueous dispersion fluid may be added after establishing a vacuum to achieve phase inversion.

In either case, the particle size of the fluid droplets of the colored resin solution in the O/W type emulsion is directly approximate to the size of the ultimately obtained toner microparticles, such that the droplets must be formed in accordance with the size of the toner particles to be produced, to achieve adequate control of the particle size distribution.

The ratio of the volume of the colored resin solution (Vp) and the volume of the aqueous dispersion fluid (Vw) when forming the O/W type emulsion is desirably such that $Vp/Vw \leqq 1$, and more desirably $0.3 \leqq Vp/Vw \leqq 0.7$. That is, when the ratio $Vp/Vw>1$, a stable O/W emulsion cannot be formed, and there is concern that a W/O type emulsion will be formed due to phase inversion during processing.

Although the aqueous dispersion fluid used to form the O/W type emulsion is basically water, it also may contain water soluble organic solvent to the extent that such content does not cause breakdown of the emulsion. For example, water may be used, or mixture of water/methanol (weight ratio: 50/50~100/0), water/ethanol (weight ratio: 50/50~100/0), water/acetone (weight ratio: 50/50~100/0), water/methylethylketone (weight ratio: 70/30~100/0).

It is desirable that a dispersion stabilizer and dispersion stabilization enhancer are added as desired to the mixture beforehand to stabilize the droplets comprising the colored resin solution in the produced O/W type emulsion. Dispersion stabilizer will have a hydrophilic colloid in an aqueous dispersion fluid, particularly, gelatin, acacia gum, agar, cellulose derivative (e.g., hydroxymethylcellulose, hydroxyethylcellulose, hydroxypropylcellulose), synthetic macromolecules (polyvinylalcohol, polyvinylpyrrolidone, polyacrylamide, polyacrylic acid salts) and the like. Solid powders also may be used. For example, tricalcium phosphate, calcium carbonate, calcium sulfate, barium carbonate, silica, titanium oxide, alumina and the like. Dispersion stabilizers are normally added to achieve a density within the aqueous dispersion fluid of 0.5 to 20 percent-by-weight, and desirably 1 to 10 percent-by-weight.

Typically, surface active agents are used as dispersion stabilizers, including natural surface active agents such as saponin, nonionic surface active agents such as alkylineoxide, glycerine, glycidol and the like, and anionic surface active agents containing acid radicals such as carbonate, sulfonate, phosphoric acid, sulfate radical, phosphate radical and the like. Particularly desirable for combined use of dispersion stabilizer and dispersion stabilization enhancer are cellulose derivative (methylcellulose derivative) and anionic surface active agent (dodecylbenzene sodium sulfonate), or polyvinylalcohol and anionic surface active agent (sodium lauryl sulfate). Dispersion stabilization enhancers are typically added to achieve a concentration in aqueous dispersion fluid of 0.001 to 1 percent-by-weight, and desirably 0.01 to 0.1 percent-by-weight.

In the method of the present invention, toner particles are produced by removing the non-water soluble organic solvent from the droplets in the O/W type emulsion obtained as described above. Removal of the non-water soluble organic solvent within the droplets may be accomplished by completely removing the non-water soluble organic solvent in the droplets by gradually raising the temperature of the entire system, and extracting and drying the toner particles from the aqueous dispersion fluid containing the toner particles, or spraying the O/W type emulsion in a dry atmosphere to completely remove the non-water soluble organic solvent in the droplets while forming the toner particles, and vaporizing the aqueous dispersion stabilizer. In the latter case, the dry atmosphere in which the O/W emulsion is sprayed may be a gas such as air, nitrogen, carbonate gas, combustion gas and the like heated from 20° C. to 250° C., generally using an airflow heated to a temperature above the boiling point of the highest boiling point solvent used. In this way after the toner particles are formed, processes may be conducted to wash, dry, and classify the toner particles as necessary.

The toner obtained by the method of the present invention desirably has a volume-average particle size of approximately 1 to 13 μm, and more desirably about 3 to 9 μm, with few interior cavities and a sharp particle size distribution. This toner is capable of maintaining a sharp particle size distribution over a long term. For this reason the toner possesses excellent charge stability and image characteristics, particularly image characteristics (image stability) during repeated copying. Specifically, the amount of cavities is desirably less than 5% of the entire toner particles, more desirably less than 4%, and most desirably less than 3%. The particle size distribution will have a coefficient of variation of less than 35%, desirably less than 30%, and more desirably less than 25%. Since the coefficient of variation is calculated as a data processing value of the Coulter Multisizer (Coulter, Inc.) this value expresses the sharpness of the particle size distribution. The coefficient of variation is represented $\sigma/D_{50}\times100$. The $\sigma$ represents a standard deviation of toner particle size distribution. The $D_{50}$ represents a volume-average particle size of toner.

When the cavities exceed 5%, the toner particles readily collapse during the manufacturing process or making repeated copies, so as to produce a broad particle size distribution cause by large amount of powdered toner, and prevent uniform charging of the toner particles and irregular charge amounts, thereby adversely affecting image characteristics. When the coefficient of variation exceeds 35%, the particle size distribution becomes broad, and irregular charge amounts result.

Fluidizing agents and cleaning agents may be added to the toner produced by the method of the present invention. Examples of useful fluidizing agents include inorganic microparticles such as silica, alumina, titanium oxide, zinc oxide, iron oxide, copper oxide, lead oxide, antimony oxide, yttrium oxide, magnesium oxide, barium titanate, ferrite, red oxide, magnesium fluoride, silicon carbide, boron carbide, silicon nitride, zirconium nitride, magnetite, magnesium stearate and the like. These inorganic microparticles may be subjected to surface processing to improve dispersibility on the surface of the toner particles, and improve environmental stability. The surface processing agent may be silane coupling agent, titanium coupling agent higher fatty acids, silicone oil and the like. Examples of useful cleaning agents include polystyrene microparticles, polymethylmethacrylate microparticles and the like. The fluidizing agent and cleaning agent are added at 0.1 to 20 parts-by-weight relative to 100 parts-by-weight of toner particles.

The toner produced by the method of the present invention is usable as a monocomponent developer which does not use a carrier, or a two-component developer which does use a carrier. A well known carrier may be used as the carrier, for example, a carrier comprising magnetic powder such as ferrite and the like, a coated carrier in which the surface of magnetic particles is covered with resin or the like, or a dispersion type carrier comprising magnetic powder dispersed in a binder resin. Such carriers desirably have a volume-average particle size of 15 to 100 μm, and more desirably 20 to 80 μm.

The present invention is described below by way of specific examples.

EXAMPLE 1

| Component | Parts-by-weight |
|---|---|
| Polyester resin (softening point: 95° C., Tg: 65° C. Mn = 3500, Mw/Mn = 2.5) | 100 |

-continued

| Component | Parts-by-weight |
|---|---|
| Copper phthalocyanine pigment (Toyo Ink K.K.) | 4 |
| Charge controller: Bontron E-84 (Orient Chemical Industries) | 2 |

The aforesaid materials were added to 400 parts-by-weight toluene used as a solvent and processed for 30 min using an ultrasonic homogenizer (output: 400 μA) to dissolve and disperse the materials in the solvent to obtain a colored resin solution.

On the other hand, 4 parts-by-weight polyvinyl alcohol (PA18: Shinetsu Kagaku Kogyo, K.K.) as a dispersion stabilizer, and 0.1 parts-by-weight sodium lauryl sulfate (Wako Pure Chemicals) as a dispersion stabilization enhancer were dissolved in 100 parts-by-weight water to produce an aqueous dispersion fluid. A model TK homomixer (Tokushu Kika Kogyo K.K.) capable of being sealed for use under reduced pressure was used to mix 100 parts-by-weight of the dispersion fluid at 3600 rpm while maintaining reduced pressure of $3.2\times10^2$ Pa as 50 parts-by-weight of the aforesaid colored resin solution were titrated into the dispersion fluid to suspend droplets having a mean particle size of approximately 6 μm in the water. Thereafter, the solution was heated to 50° C. for 3 hr while maintaining the reduced pressure to remove the toluene, then the material was repeatedly filtered and washed to obtain toner particles 1 having a volume-average particle size of 5.8 μm.

EXAMPLE 2

The colored resin solution and aqueous dispersion fluid of example 1 were used. While maintaining reduced pressure of $3.2\times10^2$ Pa, 50 parts-by-weight colored resin solution were mixed at 3600 rpm and the aqueous dispersion fluid was titrated into the resin solution, and titration was stopped when phase inversion occurred while mixing continued for 10 min. Thereafter, the solution was heated to 50° C. for 3 hr while maintaining the reduced pressure to remove the toluene, then the material was repeatedly filtered and washed to obtain toner particles 2 having a volume-average particle size of 5.7 μm.

EXAMPLE 3

| Component | Parts-by-weight |
|---|---|
| Styrene-n-butylmethacrylate resin (softening point: 98° C., Tg: 65° C. Mn = 8300, Mw/Mn = 2.3) | 100 |
| Carbon black MA#8 (Mitsubishi Chemical) | 6 |
| Charge controller: Bontron P-51 (Orient Chemical Industries) | 2 |

The aforesaid materials were added to 400 parts-by-weight toluene used as a solvent and processed for 30 min using an ultrasonic homogenizer (output: 400 μA) to dissolve and disperse the materials in the solvent to obtain a colored resin solution.

On the other hand, 4 parts-by-weight tricalcium phosphate (Wako Pure Chemicals) as a dispersion stabilizer, and 0.1 parts-by-weight sodium lauryl sulfate (Wako Pure Chemicals) as a dispersion stabilization enhancer were dissolved in 100 parts-by-weight water to produce an aqueous dispersion fluid. A model TK homomixer (Tokushu Kika Kogyo K.K.) capable of being sealed for use under reduced pressure was used to mix 100 parts-by-weight of the dispersion fluid at 4900 rpm while maintaining reduced pressure of 1.5×10 Pa as 50 parts-by-weight of the aforesaid colored resin solution were titrated into the dispersion fluid to suspend droplets having an average particle size of approximately 6 μm in the water. Thereafter, the solution was heated to 50° C. for 3 hr while maintaining the reduced pressure to remove the toluene, and after the tricalcium phosphate was dissolved via concentrated hydrochloric acid, the material was repeatedly filtered and washed to obtain toner particles 3 having a volume-average particle size of 6.1 μm.

EXAMPLE 4

| Component | Parts-by-weight |
|---|---|
| Polyester resin (softening point: 103° C., Tg: 68° C. Mn = 6900, Mw/Mn = 2.2 | 100 |
| Quinacridone pigment (Dainichiseika Color and Chemicals Manufacturing Co.) | 4 |
| Charge controller: Bontron E-81 (Orient Chemical Industries) | 2 |

The aforesaid materials were added to 400 parts-by-weight toluene used as a solvent and processed for 30 min using an ultrasonic homogenizer (output: 400 μA) to dissolve and disperse the materials in the solvent to obtain a colored resin solution.

On the other hand, 4 parts-by-weight polyvinyl alcohol (PA05: Shinetsu Kagaku Kogyo, K.K.) as a dispersion stabilizer, and 0.1 parts-by-weight sodium lauryl sulfate (Wako Pure Chemicals) as a dispersion stabilization enhancer were dissolved in 100 parts-by-weight water to produce an aqueous dispersion fluid. A model TK homomixer (Tokushu Kika Kogyo K.K.) capable of being sealed for use under reduced pressure was used to mix 100 parts-by-weight of the dispersion fluid at 3800 rpm while maintaining reduced pressure of $3.2\times10^2$ Pa as 50 parts-by-weight of the aforesaid colored resin solution were titrated into the dispersion fluid to suspend droplets having a mean particle size of approximately 6 μm in the water. Thereafter, the solution was heated to 50° C. for 3 hr while maintaining the reduced pressure to remove the toluene, then the material was repeatedly filtered and washed to obtain toner particles 4 having a volume-average particle size of 5.9 μm.

EXAMPLE 5

The colored resin solution and aqueous dispersion fluid of example 4 were used. While maintaining reduced pressure of $3.2\times10^2$ Pa, 50 parts-by-weight colored resin solution were mixed at 3800 rpm and the aqueous dispersion fluid was titrated into the resin solution, and titration was stopped when phase inversion occurred while mixing continued for 10 min. Thereafter, the solution was heated to 50° C. for 3 hr while maintaining the reduced pressure to remove the toluene, then the material was repeatedly filtered and washed to obtain toner particles 5 having a volume-average particle size of 5.8 μm.

COMPARATIVE EXAMPLE 1

The colored resin solution and aqueous dispersion fluid of example 1 were used. While maintaining a pressure of $1.0\times10^5$ Pa (atmospheric pressure), 100 parts-by-weight dispersion fluid was mixed at 3600 rpm using a model TK homomixer and 50 parts-by-weight of the colored resin solution was titrated into the dispersion fluid to suspend droplets having an average particle size of 6 μm in the fluid. Thereafter, the solution was heated to 50° C. for 3 hr while maintaining the pressure at $3.2\times10^2$ Pa to remove the toluene, then the material was repeatedly filtered and washed to obtain toner particles 6 having a volume-average particle size of 6.1 μm.

COMPARATIVE EXAMPLE 2

The colored resin solution and aqueous dispersion fluid of example 1 were used. While maintaining a reduced pressure of $7.9\times10^{-3}$ Pa, 100 parts-by-weight dispersion fluid was mixed at 3800 rpm using a model TK homomixer and 50 parts-by-weight of the colored resin solution was titrated into the dispersion fluid to suspend droplets having an average particle size of 6 μm in the fluid. Thereafter, the solution was heated to 50° C. for 3 hr while maintaining the reduced pressure at $3.2\times10^2$ Pa to remove the toluene, then the material was repeatedly filtered and washed to obtain toner particles 7 having a volume-average particle size of 5.7 μm.

COMPARATIVE EXAMPLE 3

The colored resin solution and aqueous dispersion fluid of example 4 were used. While maintaining a pressure of $1.0\times10^5$ Pa (atmospheric pressure), 100 parts-by-weight dispersion fluid was mixed at 3900 rpm using a model TK homomixer and 50 parts-by-weight of the colored resin solution was titrated into the dispersion fluid to suspend droplets having an average particle size of 6 μm in the fluid. Thereafter, the solution was heated to 50° C. for 3 hr while maintaining a vacuum of $3.2\times10^2$ to remove the toluene, then the material was repeatedly filtered and washed to obtain toner particles 6 having a volume-average particle size of 6.2 μm.

Toner Production

To toner particles 1, 2, 6, and 7 were added 0.5 percent-by-weight silica microparticles (H-2000; Hoechst Japan) and 1 percent-by-weight titanium dioxide microparticles (T-805; Japan Aerosil Co., Ltd.) a, and the mixture was mixed for 3 min using a Henschel mixer to obtain toners 1, 2, 6, and 7. To toner particles 3 was added 0.3 percent-by-weight silica microparticles (R-97; Japan Aerosil Co., Ltd.), and the mixture was mixed for 2 min using a Henschel mixer to obtain toner 3. To toner particles 4, 5, and 8 was added 0.9 percent-by-weight silica microparticles (R-976; Japan Aerosil Co., Ltd.), and the mixture was mixed for 2 min using a Henschel mixer to obtain toners 4, 5, and 8.

Carrier Production

| Component | Parts-by-weight |
|---|---|
| Polyester resin (softening point: 123° C., Tg: 65° C. acid value: 230 KOHmg/g; hydroxide value: 40 KOHmg/g) | 100 |
| Ferrite particles MFP-2 (TDK) | 500 |

-continued

| Component | Parts-by-weight |
|---|---|
| Carbon black MA#8 (Mitsubishi Chemicals) | 2 |

These materials were thoroughly mixed using a feather mill, then kneaded using a twin-shaft extrusion device, and the cooled mixture was coarsely pulverized using a feather mill, and subsequently finely pulverized using a jet mill, and air classified using a forced air classifying device to obtain carrier particles having a volume-average particle size of 50 μm.

Evaluation Methods

1) Amount of Charge

First, the toners of examples 1 to 3 and comparative examples 1 and 2 were added at a rate of 5 percent-by-weight to the carrier to obtain 30 g of developer, which was loaded in a polyethylene bottle of 50 cc capacity and mixed for 5 min at 120 rpm and rotated for 900 min. Thereafter the amount of charge was measured. The measurement results are show in Table 1 below.

TABLE 1

| | Amount of charge (μC/g) | |
|---|---|---|
| | 5 min. | 900 min. |
| Ex. 1 | −21.3 | −20.9 |
| Ex. 2 | −23.4 | −22.7 |
| Ex. 3 | +20.7 | +19.3 |
| Comp. Ex. 1 | −17.7 | −11.2 |
| Comp. Ex. 2 | −24.5 | −13.0 |

2) Image Characteristics

The toners of examples 1 and 2 and comparative examples 1 and 2 were mixed with carrier to obtain a developer having 5 percent-by-weight of toner. The developer was used for resistance printing tests of 10,000 sheets using a model CF-70 printer (Minolta Co.), and the initial images and images after 10,000 printings were examined. The toners of examples 4 and 5 and comparative example 3 were used for resistance printing tests of 3,000 sheets using a model Fine Writer 601 (Minolta Co.), and the initial images and images after 3,000 printings were examined. The results are shown in Table 2 below. Ranking by visual discrimination are shown below.

O: No background fog
Δ: Slight background fog that posed no practical problem
X: Severe background fog

TABLE 2

| | Image characteristics | |
|---|---|---|
| | Initial | After printing |
| Ex. 1 | ○ | ○ |
| Ex. 2 | ○ | ○ |
| Ex. 4 | ○ | ○ |
| Ex. 5 | ○ | ○ |
| Comp. Ex. 1 | Δ | X |
| Comp. Ex. 2 | Δ | X |
| Comp. Ex. 3 | Δ | X |

3) Interior Cavities in Toner

The toners of examples 1 to 5 and comparative examples 1 to 3 were measured to determine the amount of cavities within the toner. The amount of cavities were measured by photographic enlargement of a section of toner particle sectioned by microtome and viewed by a transmission electron microscope (TEM). The amount of cavities are represented by Mc/Mt×100(%). The Mc represents area of cavities on the photographic enlargement. The Mt represents area of toner particles on the photographic enlargement. If the amount of cavity was less than 5%, the toner did not collapse during resistance printing, and the toner produced excellent image characteristics because the toner particles did not increase. Results are shown in Table 3 below.

TABLE 3

| | Interior cavities in toner (%) |
|---|---|
| Ex. 1 | 1.5 |
| Ex. 2 | 1.1 |
| Ex. 3 | 1.9 |
| Ex. 4 | 1.8 |
| Ex. 5 | 1.5 |
| Comp. Ex. 1 | 7.9 |
| Comp. Ex. 2 | 16.4 |
| Comp. Ex. 3 | 7.6 |

4) Particle Size Distribution

The toners of examples 1 to 5 and comparative examples 1 to 3 were measured using a Coulter Multisizer (Coulter Co.) to determine the coefficient of variation and the 50% volume distribution particle size. These measurements were performed on the toner at the beginning of the print resistance tests, and after 3,000 printings (Examples 4 and 5 and Comparative Example 3) and 10,000 printings (Examples 1 and 2 and Comparative Examples 1 and 2). If the coefficient of variation was less than 35%, the particle size distribution was sharp, and the toners produced excellent images without fogging due to the uniform charge of the toner. Results are shown in Table 4 below.

TABLE 4

| | Initial | | After printing | |
|---|---|---|---|---|
| | volume-average particle size (μm) | Coefficient of variation (%) | volume-average particle size (μm) | Coefficient of variation (%) |
| Ex. 1 | 5.8 | 24.8 | 5.7 | 25.2 |
| Ex. 2 | 5.7 | 22.6 | 5.6 | 23.1 |
| Ex. 3 | 6.1 | 28.9 | — | — |
| Ex. 4 | 5.9 | 29.1 | 5.7 | 33.0 |
| Ex. 5 | 5.8 | 27.8 | 5.6 | 31.4 |
| Comp. Ex. 1 | 6.1 | 44.3 | 5.2 | 64.2 |
| Comp. Ex. 2 | 5.7 | 61.7 | 4.2 | 83.0 |
| Comp. Ex. 3 | 6.2 | 46.2 | 4.8 | 66.9 |

As can be clearly understood from these results, the toners of examples 1 to 5 of the present invention exhibit adequate charge stability, and produce excellent images both initially and after the resistance print test. The toners of comparative examples 1 to 3 did not have adequate charge stability, produced slight fog initially, and the fogging increased after the resistance print test. Table 4 clearly shows that the toners of comparative examples 1 to 3 readily collapsed due to the large internal cavities within the toner particles, and the increase in smaller particles is believed to be due to the collapse of these toner particles.

Although the present invention has been fully described by way of examples with reference to the accompanying drawings, it is to be noted that various changes and modification will be apparent to those skilled in the art. Therefore, unless otherwise such changes and modifications depart from the scope of the present invention, they should be construed as being included therein.

What is claimed is:

1. A method of producing a toner for developing electrostatic latent images comprising the steps of:

preparing a coloring resin solution containing a binder resin, a colorant and a non-aqueous organic solvent;

forming an oil-in-water type emulsion by adding the coloring resin solution to an aqueous medium under reduced pressure of $5.0\times10^4$ to $1.0\times10^{-2}$ Pa; and removing the non-aqueous organic solvent from the oil-in-water type emulsion.

2. The method as claimed in claim 1, wherein the reduced pressure is $3.0\times10^4$ to $1.0\times10^{-1}$ Pa.

3. The method as claimed in claim 1, wherein the reduced pressure is $1.4\times10^4$ to 1.0 Pa.

4. The method as claimed in claim 1, wherein the coloring resin solution has a resin concentration of 5 to 50% by weight.

5. The method as claimed in claim 1, wherein an amount of cavities in the toner is less than 5%.

6. The method as claimed in claim 1, wherein the toner has a coefficient of variation of less than 35%.

7. The method as claimed in claim 1, wherein the toner has a volume-average particle size of 3 to 9 $\mu$m.

8. The method as claimed in claim 1, wherein the binder resin has a glass transition temperature of 50 to 70° C., a number-average molecular weight of 1,000 to 50,000, and a ratio (a weight-average molecular weight/a number-average molecular weight) of 2 to 60.

9. The method as claimed in claim 8, wherein the binder resin has the ratio of 2 to 5.

10. The method as claimed in claim 8, wherein the binder resin has the ratio of 20 to 50.

11. A method of producing a toner for developing electrostatic latent images comprising the steps of:

preparing a coloring resin solution containing a binder resin, a colorant and a non-aqueous organic solvent;

forming an oil-in-water type emulsion by adding an aqueous medium to the coloring resin solution under reduced pressure of $5.0\times10^4$ to $1.0\times10^{-2}$ Pa and making a phase inversion emulsification; and removing the non-aqueous organic solvent from the oil-in-water type emulsion.

12. The method as claimed in claim 11, wherein the reduced pressure is $3.0\times10^4$ to $1.0\times10^{-1}$ Pa.

13. The method as claimed in claim 11, wherein the reduced pressure is $1.4\times10^4$ to 1.0 Pa.

14. The method as claimed in claim 11, wherein the coloring resin solution has a resin concentration of 5 to 50% by weight.

15. The method as claimed in claim 11, wherein an amount of cavities in the toner is less than 5%.

16. The method as claimed in claim 11, wherein the toner has a coefficient of variation of less than 35%.

17. The method as claimed in claim 11, wherein the toner has a volume-average particle size of 3 to 9 $\mu$m.

18. The method as claimed in claim 11, wherein the binder resin has a glass transition temperature of 50 to 70° C., a number-average molecular weight of 1,000 to 50,000, and a ratio (a weight-average molecular weight/a number-average molecular weight) of 2 to 60.

19. The method as claimed in claim 18, wherein the binder resin has the ratio of 2 to 5.

20. The method as claimed in claim 18, wherein the binder resin has the ratio of 20 to 50.

* * * * *